US005437117A

United States Patent [19]

Mackey, III

[11] Patent Number: 5,437,117

[45] Date of Patent: Aug. 1, 1995

[54] BULLET ALARM

[76] Inventor: Earl H. Mackey, III, P.O. Box 5351, Abilene, Tex. 79608

[21] Appl. No.: 269,660

[22] Filed: Jul. 1, 1994

[51] Int. Cl.[6] ..... F41A 17/06

[52] U.S. Cl. ..... 42/1.01; 42/70.01; 42/70.09

[58] Field of Search ..... 42/1.01, 70.01, 84, 42/70.07; 116/35 R, 33, 68; 340/540

[56] References Cited

U.S. PATENT DOCUMENTS

| | | | |
|---|---|---|---|
| 666,405 | 1/1901 | Baggett . | |
| 2,600,363 | 6/1952 | Morris | 177/311 |
| 3,044,204 | 7/1962 | Zimmerman | 42/84 |
| 3,728,675 | 4/1973 | Horn et al. | 340/65 |
| 4,155,079 | 5/1979 | Chiu et al. | 340/571 |
| 4,375,135 | 3/1983 | Wigger . | |
| 4,476,644 | 10/1984 | Laing . | |
| 4,739,569 | 4/1988 | Battle | 42/1.01 |
| 4,829,692 | 5/1989 | Guild | 42/1.01 |
| 5,001,465 | 4/1991 | Vroom et al. | 340/572 |
| 5,016,378 | 5/1991 | Sain | 42/70.06 |
| 5,260,689 | 11/1993 | Meyers et al. | 340/571 |
| 5,270,686 | 12/1993 | Martinez | 340/689 |

*Primary Examiner*—Charles T. Jordan
*Assistant Examiner*—Christopher Keith Montgomery
*Attorney, Agent, or Firm*—Richards, Medlock & Andrews

[57] ABSTRACT

A firearm safety device in the size and shape of ammunition is inserted in the chamber of a firearm. The safety device produces an audible alarm when the firearm is moved or handled, thus signaling a warning sound that the firearm is being moved or handled. The safety device, when it is inserted in the chamber of the firearm, further helps to prevent accidental discharge of the firearm by replacing a live round of ammunition.

13 Claims, 2 Drawing Sheets

BULLET ALARM

TECHNICAL FIELD OF THE INVENTION

The present invention relates to alarms and in particular an alarm having an audible signal for signaling unwanted handling of a firearm when the firearm is moved from one position to another position.

BACKGROUND OF THE INVENTION

There have been some devices and apparatus developed to sound an alarm when a weapon is mishandled. There are also a number of devices designed to minimize accidental discharges of firearms. The present invention relates to a alarm system which can be placed in the chamber of a weapon which will become activated if the weapon is moved or picked up, for example, by a young child.

The alarm offers several advantages which include that it is the shape of a bullet and can fit into the chamber of the weapon whether it be a pistol, rifle or shotgun. The invention has the advantage that the bullet alarm is loaded into the chamber and this provides an extra safety factor in that a live round is not in the chamber. This is especially useful in semiautomatic weapons where action of the round exploding is used to cock the weapon and reload for the next round. If the alarm does not frighten the person that has picked up the weapon such as a child, certain weapons will not operate even if the trigger is pulled because the firing pin will fall onto the alarm rather than a live round. Of course, the alarm is also useful to alert the movement of a weapon whether are not the weapon is loaded.

SUMMARY OF THE INVENTION

A firearm safety device in the shape and size of ammunition and is inserted into the chamber of a firearm. The device comprises a housing shaped to fit into the chamber of a firearm having a power source which electrically connects, and provides power, to an alarm circuit when the firearm is moved from one position to another position. When the firearm is moved, a position responsive switch closes, or becomes activated, whereby the power source is electrically connected to, and operates, the alarm circuit. The alarm circuit produces an electrical signal which drives an audio speaker, which in turn, produces an audible noise indicating the firearm has been moved or handled.

In another embodiment, the firearm safety device also includes a power or actuator switch which prevents the alarm circuit from operating even though the position responsive switch may become activated by movement of the firearm. When the power switch closes, it allows the alarm circuit to operate when the position responsive switch is activated. The power switch becomes closed (or activated) by insertion of the safety device into the chamber of the firearm or by an on/off switch which is manually operated and located on the firearm safety device.

DETAILED DESCRIPTION

Figure 1:
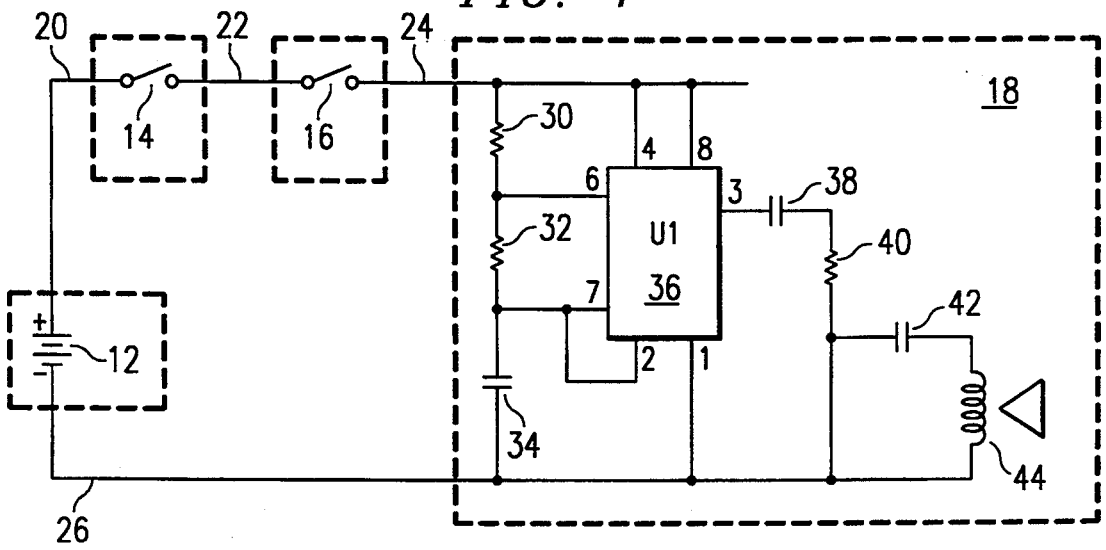
FIG. 1 is a circuit diagram of the invention.

FIG. 1 shows the circuitry of the present invention of the audible firearm alarm. In the figures, like numbers are used for corresponding elements. The circuit is sized to fit into the chamber of a pistol, rifle or shotgun. It is of importance to note that the alarm can be in various shapes and sizes of ammunition for the types of firearms available.

In the preferred embodiment, the alarm contains power source 12 which provides a source of electrical power to alarm circuit 18. Power source 12 can be a battery. Power source 12 is electrically connected to power switch 14 via conductor 20. Power switch 14 is electrically connected to position responsive switch 16 via conductor 22. Power switch 14 is not required but is preferred. Switch 16 is electrically connected via conductor 24 to alarm circuit 18. Power source 12, switch 14 and switch 16 function to provide a power source to alarm circuit 18 when switches 14 and 16 are closed. When switch 14 and/or switch 16 are not activated, the circuitry in FIG. 1 is open, thereby not having a closed circuit. Switch 14 typically acts like an energizing switch thereby preventing the power source 12 to be electrically connected to alarm circuit 18 even when switch 16 is closed. This allows the alarm to be handled without sounding until the alarm is placed in the firearm. Both switch 14 and switch 16 must be closed in order for the power source 12 to be electrically connected to alarm circuit 18. The advantage of having power switch 14 in the circuitry is that it prevents operation of the alarm circuit, thus preventing operation of the alarm circuit 18 until the appropriate time which is determined by the user, such as when the firearm alarm is inserted in the chamber of the firearm or when the user turns the power source "on". Switch 14 may be located anywhere within the circuitry as discussed below.

Figure 2:
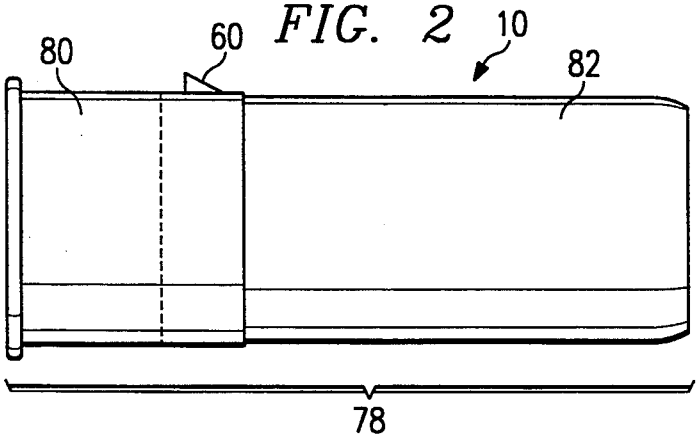
FIG. 2 is a side view of the invention in the form of a shotgun shell.
Figure 3A:
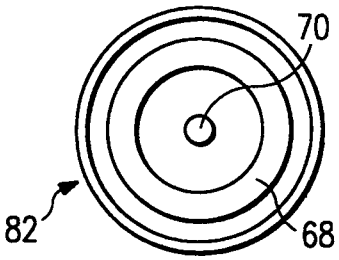
FIG. 3A is an end view along line 3—3 of the alarm circuit housing showing the contact areas.
Figure 3:
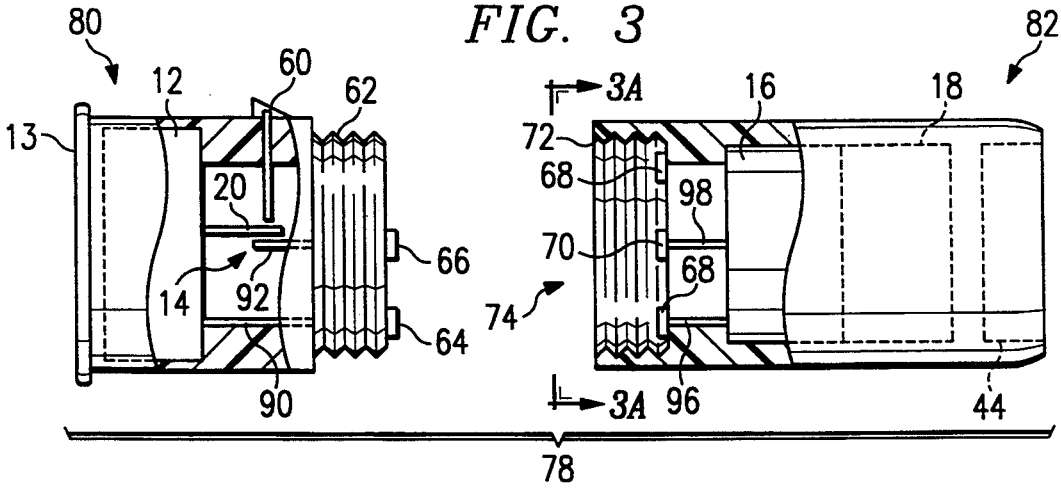
FIG. 3 is a side view of the two-piece housing of the present invention.

Referring to FIG. 2 is shown one embodiment of the alarm 10. The alarm 10 is contained in the two-piece housing 78 having a power source housing 80 and alarm circuit housing 82. In the preferred embodiment, power source 12 is a D.C. battery and power switch 14 comprises an extension 60 which closes power switch 14 by insertion of alarm 10 into the chamber of the firearm. When inserted, extension 60 is depressed when it contacts the inner wall of the chamber of the firearm, thus closing power switch 14 and providing an electrical path between conductor 20 and conductor 22. With reference to FIG. 3, in the preferred embodiment, power source 12 is contained within a chamber in power source housing 80. Power source housing 80 further contains threads 62 and electrical contacts 64 and 66 thereon. The power source housing may be disposable, such that the whole housing is replaced when the battery is low. Alternatively, the power source can be replaceable/removable by providing a screw cap 13. Power source housing 80 may be threaded into alarm circuit housing 82, thus providing a power source to the circuitry located in alarm circuit housing 82. The advantage of enabling power source housing 80 containing power source 12 to be threaded into alarm circuit housing 82 is that it provides an economical way to replace the battery when it gets low on power. Additionally, power source housing 80 may also have a mechanism which indicates the battery is low on power, such as a "low battery" indication light, or a piezo beeper which produces an audible signal indicating a "low battery".

Alarm circuit housing 82 has receiving threads 72 to receive power source housing 80. Within the threaded receiving area 74 are contacts 68 and 70. With additional reference to FIG. 3A, contact 70 is an electrically conductive contact located approximately in the center of area 74. Contact 68 is generally a concentric circle also made of electrically conductive material. As power source housing 80 is threaded into alarm circuit housing 82, contact 66 makes contact with contact 70 while contact 64 also comes into contact with contact 68. Thus, when power source housing 80 is screwed into alarm circuit housing 82, alarm circuit 18 has a source of electrical power.

Within power source housing 80, power source 12 is electrically connected to contact 64 via conductor 90. Power source 12 is also connected to conductor 20. Extension 60, when depressed, provides contact between conductor 20 and conductor 92, thereby closing switch 14 and providing electrical connection between power source 12 and contact 66. With reference to FIGS. 1 and 3, conductor 92, contact 66, contact 70 and conductor 98 all form the electrical conductor 22 in FIG. 1. Additionally, conductor 90, contact 64, contact 68 and conductor 96 all form the electrical conductor 26 in FIG. 1.

Figure 4:
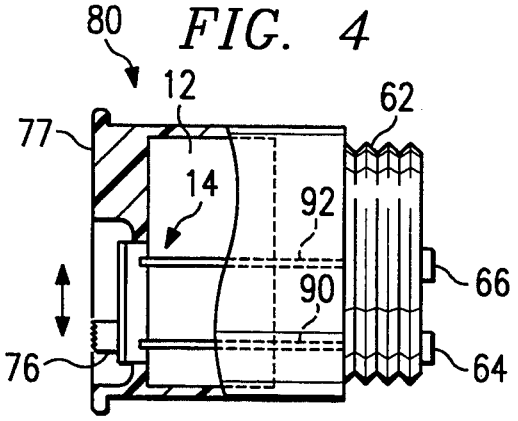
FIG. 4 is an alternative embodiment showing the on/off switch.
Figure 4A:
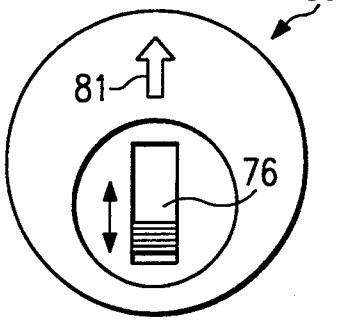
FIG. 4A is an end view of FIG. 4.

In an alternative embodiment, power switch 14 is shown as on/off switch 76 in FIG. 4 and FIG. 4A. On/off switch 76 can be manually operated, thus closing power switch 14, providing an electrical path between power source 12 and switch 16. On/off switch 76 is shown located in a recess on the rear of 77 of power source housing 80. The rear 77 of the power source housing 80 preferably is provided with index mark 81 which indicates the orientation where the motion switch 16 will be open.

In the preferred embodiment, extension 60 is located extending from power source housing 80, but may be located extending from alarm circuit housing 82. Additionally, on/off switch 76 may be utilized in lieu of extension 60 to close power switch 14 and also may be located on power source housing 80 or alarm circuit housing 82.

In the preferred embodiment, position responsive switch 16 and alarm circuit 18 are contained within alarm circuit housing 82. Switch 16 can be any type of switch which responds to movement, such as a mercury switch, which structures and operation are well known in the art. Switch 16 sometimes is referred to as an actuator switch. Switch 16 provides a first output (open) when the firearm is in one position and a second output (closed) when the firearm is moved to another position. Switch 16 enables the power source 12 to be electrically connected to alarm circuit 18 when switch 16 is closed. Switch 16 is activated by movement, thereby becoming closed in response to movement of the firearm when alarm 10 is in the chamber of the firearm. Therefore, when the firearm contains alarm 10 and the firearm is moved, the power source becomes electrically connected to the alarm circuit which produces an audible signal, as will be discussed in the next paragraph.

Figure 5:
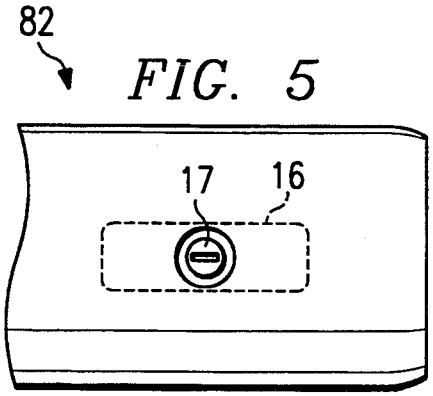
FIG. 5 is a side view of the housing showing one orientation of the position responsive switch located in the housing.
Figure 5A:
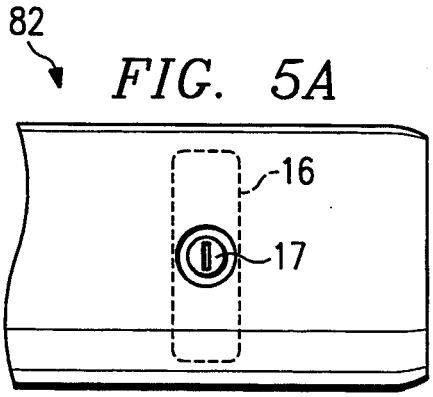
FIG. 5A is a side view of the housing showing an alternative orientation of the position responsive switch located in the housing.
Figure 5B:
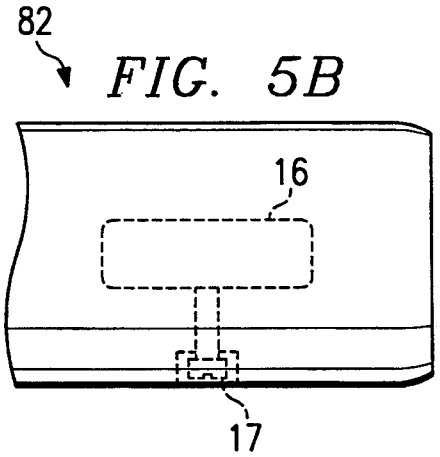
FIG. 5B is a top view of FIG. 5.

With reference to FIGS. 5, 5A and 5B, switch 16 is mounted within alarm circuit housing 82 with a set screw 17. Switch 16 is pivotally or rotatably mounted on set screw 17. Set screw 17 is attached to alarm circuit housing 82 and extends outward in a recess to allow angular adjustment of switch 16. This allows switch 16 to be rotated or pivoted in relation to the body of the alarm. The advantage of having switch 16 mounted in such a way is to allow the alarm to be use in firearms which are placed in storage in a vertical position, such as a rifle or shotgun. When the alarm is inserted in a firearm to be stored in a vertical position, switch 16 must be rotated to a position substantially perpendicular to the axial position of the firearm. This is shown generally in FIG. 5A. The head of set screw 17 can be used to indicate orientation of switch 16.

With reference to FIG. 1, alarm circuit 18 has integrated circuit U1. Switch 16 is electrically connected via conductor 24 to resistor 30 and pin 8 and pin 4 of U1. Resistor 30 is also connected to resistor 32 and pin 6 of U1. Resistor 32 is connected to pin 6 and pin 7 and pin 2 of U1 and also to capacitor 34. Capacitor 38 is connected to pin 3 of U1 and to resistor 40. Resistor 40 is also connected to capacitor 42 and negative conductor 26. Capacitor 42 is connected to audio speaker 44. Audio speaker 44, pin 1 of U1, and capacitor 34 are all connected to negative conductor 26 which is also connected to power source 12.

The values of the discrete electrical components of the circuitry in FIG. 1 may be any value which accomplishes the desired objects of the invention. A person of ordinary skill in the art can select the appropriate values of components to produce the desired objects of the invention. Typically, U1 is an SK 3564 timer oscillator, or any discrete components, circuitry, integrated circuit, or any combination of the foregoing which is equivalent or which accomplishes the objects of the invention. Alarm circuit 18 and switch 16 are preferably contained in alarm circuit housing 82.

With continued reference to FIG. 1, power source 12 is electrically connected through switch 14 and switch 16 to alarm circuit 18. Switch 16 is activated thereby closing the circuitry in FIG. 1 (assuming switch 14 is also closed) in response to movement of the firearm when firearm alarm 10 is in situ therein. Power source 12 becomes electrically connected to alarm circuit 18 when switch 14 and switch 16 are closed. Alarm circuit 18 becomes operational and produces an electrical signal having a frequency in the range of approximately 300 hertz (Hz) to 10 kilohertz (KHz). This electrical signal is then converted into an audible signal via speaker 44. Speaker 44 produces a loud audible signal which can be detected by a human. Alternatively, the audible signal may be produced by a piezoelectric transducer, piezo loudspeaker or crystal loudspeaker. Therefore, in order to produce the audible signal, power switch 14 is closed by insertion of alarm 10 into the chamber or by turning the power "on" via on/off switch 76, and switch 16 becomes activated (closed) by movement of the firearm which has firearm alarm 10 in its chamber. Alternatively, on/off switch 14 may be discarded and the sounding of the alarm controlled only by the orientation of the alarm.

This invention may be produced in various sizes and shapes in the form of ammunition for various pistols, shotguns, and rifles as shown generally in FIGS. 2 and 3.

It will obvious to those skilled in the art that many alterations and modifications may be made to the described invention without departing from the invention. Accordingly, it is intended that all such alterations and modifications be considered within the spirit and scope of the invention as defined by the appended claims.

I claim:

1. A firearm safety device, comprising:

(a) a housing adapted to be received into a chamber of a firearm;

(b) a position responsive switch enclosed within said housing, said switch having a first output when in a first position, and a second output when in a second position;

(c) an alarm circuit connected to said switch for powering a speaker;

(d) a speaker attached to said housing and electrically connected to said circuit for producing an audible alarm when the firearm is moved from a first position to a second position and (e) a power source contained within said housing to supply electrical power to said switch and said circuit.

2. The device as recited in claim 1, further comprising a power switch for energizing the device for operation.

3. The device as recited in claim 2 wherein said position responsive switch is a mercury switch,

4. The device as recited in claim 2, further comprising a set screw whereby said position responsive switch is mounted to said set screw to allow for rotation or pivot of said position responsive switch.

5. The device as recited in claim 3 further comprising a set screw pivotally attached to said housing and further attached to said position responsive switch whereby rotation of said set screw changes the orientation of said position responsive switch,

6. A safety device for insertion into a chamber of a firearm, comprising:

(a) a power source;

(b) a power switch connected to said power source, said power switch being activated when the safety device is inserted into the chamber of the firearm;

(c) an actuator switch activated in response to movement of the firearm and connected to said power switch; and (d) an alarm circuit for producing an audio alarm signal when said power switch and said actuator switch are both activated thereby connecting said power source to said alarm circuit.

7. The device as recited in claim 6, wherein said actuator switch is a mercury switch.

8. The device as recited in claim 6, wherein said power switch includes a contact member extending from the safety device whereby said contact member activates said power switch when the safety device is inserted into the chamber of the firearm.

9. The device as recited in claim 8, further comprising a set screw engaging said actuator switch whereby the position of said actuator switch is changed when said set screw is rotated.

10. A firearm safety device, comprising:

(a) a housing adapted to be received into a chamber of a firearm;

(b) a position responsive switch enclosed within said housing, said switch having a first output when in a first position, and a second output when in a second position;

(c) an alarm circuit connected to said switch for powering a speaker;

(d) a speaker attached to said housing and electrically connected to said circuit for producing an audible alarm when the firearm is moved from a first position to a second position;

(e) a power source contained within said housing to supply electrical power to said switch and said circuit; and (f) a power switch for energizing the device for operation, said power switch activating and energizing the device when the device is received in the chamber of the firearm.

11. The device as recited in claim 10, further comprising a set screw engaging said position responsive switch whereby the position of said position responsive switch is changed when said set screw is rotated.

12. A firearm safety device, comprising:

(a) a housing adapted to be received into a chamber of a firearm;

(b) a position responsive switch enclosed within said housing, said switch having a first output when in a first position, and a second output when in a second position;

(c) an alarm circuit connected to said switch for powering a speaker;

(d) a speaker attached to said housing and electrically connected to said circuit for producing an audible alarm when the firearm is moved from a first position to a second position;

(e) a power source contained within said housing to supply electrical power to said switch and said circuit; and (f) a power switch for energizing the device for operation, said power switch including a contact member extending from the safety device whereby said contact member activates said power switch when the safety device is inserted in the chamber of the firearm.

13. The device as recited in claim 12, further comprising a set screw pivotally attached to said housing and further attached to said position responsive switch whereby rotation of said set screw changes the orientation of said position responsive switch.

* * * * *